US005169142A

United States Patent [19]

Muck et al.

[11] Patent Number: 5,169,142

[45] Date of Patent: Dec. 8, 1992

[54] SORTER WITH NOISE REDUCTION

[75] Inventors: Dennis N. Muck, Walworth; Stefan A. Jasinski; Frank A. Grossi, both of Webster; James A. Barber, Rochester; Paul H. Hines, Fairport, all of N.Y.

[73] Assignee: Xerox Corporation, Stamford, Conn.

[21] Appl. No.: 809,693

[22] Filed: Dec. 17, 1991

[51] Int. Cl.[5] ..... B65H 39/10

[52] U.S. Cl. ..... 271/293; 271/294; 74/443

[58] Field of Search ..... 271/292-294; 74/443

[56] References Cited

U.S. PATENT DOCUMENTS

| | | | |
|---|---|---|---|
| 3,808,906 | 5/1974 | Bowers | 74/443 |
| 4,143,751 | 3/1979 | Foster et'al. | 198/365 |
| 4,328,963 | 5/1982 | DuBois et al. | 271/293 |
| 4,332,377 | 6/1982 | DuBois et al. | 271/293 |
| 4,391,461 | 7/1983 | Deibele | 292/204 |
| 4,437,356 | 3/1984 | Imazaike | 74/443 |
| 4,466,608 | 8/1984 | DuBois et al. | 271/293 |
| 4,558,860 | 12/1985 | Stemmle | 271/293 |
| 4,589,653 | 5/1986 | Stemmle | 271/293 |
| 4,867,058 | 9/1989 | Luckhurst | 101/93.05 |
| 4,878,660 | 11/1989 | Irie | 271/293 |
| 5,087,029 | 2/1992 | Sugishima | 271/293 |

*Primary Examiner*—H. Grant Skaggs

[57] ABSTRACT

Reducing the operating impact noise of a moving bins sorter of the type in which the bins of the sorter are sequentially incremented with a rotatable open mouthed "C" cam drive, where the open ends of the "C" cam on opposite sides of the open mouth provide operative bin engaging cam surfaces for engaging a cam engaging portion of the bins, without adversely affecting the contacting surfaces wear rate, by providing cantilevered arms of limited flexibility supporting the bin engaging end portions of the "C" cam to provide limited flexing of at least one of the bin engaging end portions of the "C" cam when at least one of these bin engaging end portions operatively engages a bin, for impact noise reduction. The "C" cam may further include an internal chordal cross brace. The "C" cam may further include undercut or relieved areas to make the cantilevered arms thinner adjacent the bin engaging end portions, and/or a highly resilient donut shaped member mounted internally of the open mouth of the "C" cam and positioned to partially engage the cam engaging portion of the bin entering the open mouth of the "C" cam.

3 Claims, 2 Drawing Sheets

SORTER WITH NOISE REDUCTION

Figure 1:
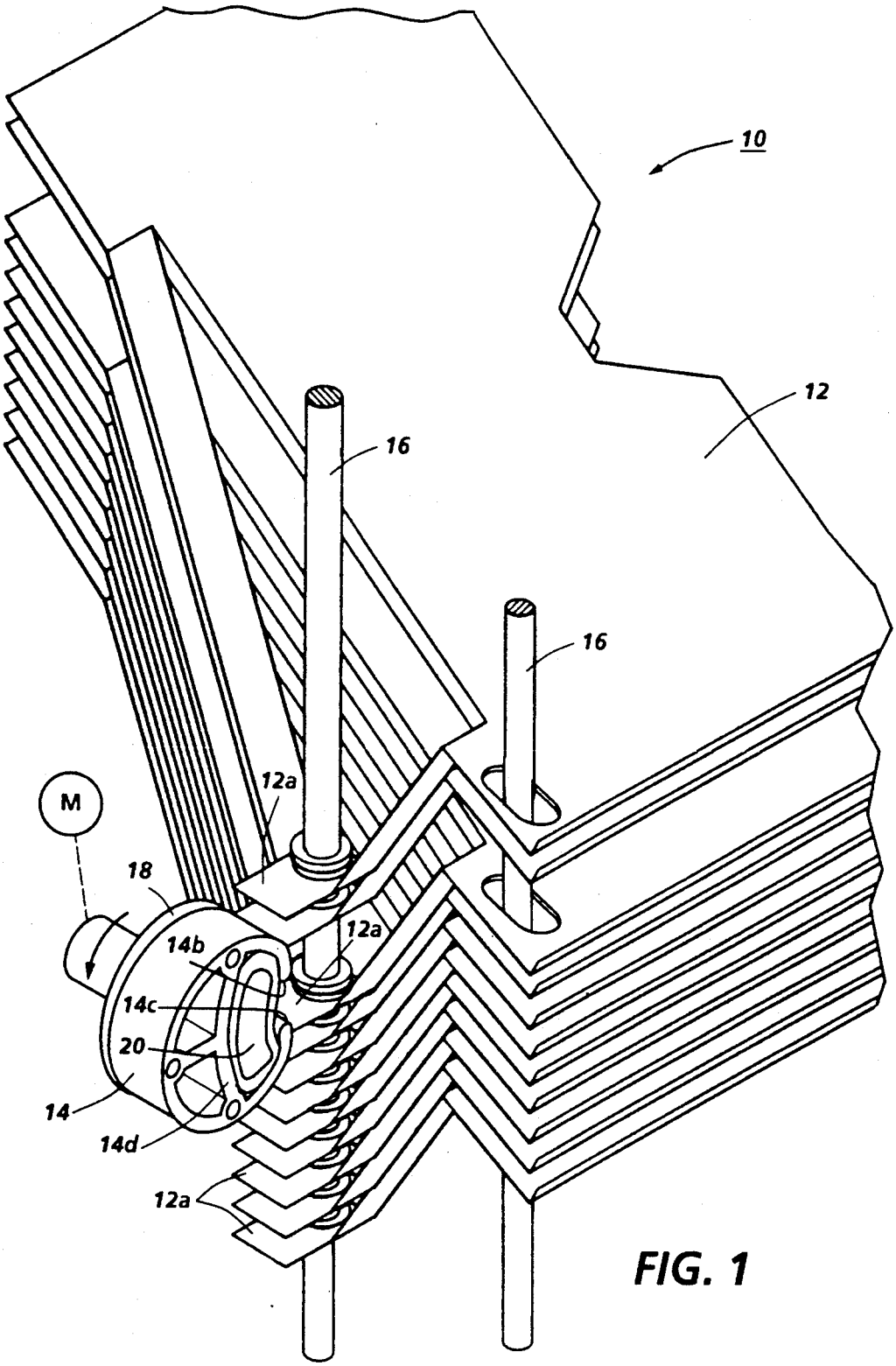

There is disclosed herein a simple, low cost, quieter and lower impact improved drive system for moving bin sorters or compliers, particularly of the "C" cam incremental bin drive type. It will be appreciated that this system can also or alternatively be used to provide for a faster or speeded up sorter without an increase in the ambient noise level.

The disclosed system does not require any additional components or any significant increase in manufacturing cost or manufacturing changes. Only the change or substitution of a single existing component, with a new integral shock absorbing design, is needed in existing commercial sorters of this type. Thus, the present system is particularly suitable for change or substitution conversion (quieting) of existing sorters or proven sorter designs for an office environment. Office copier noise pollution and noise reduction are important design concerns, especially as previous office noise sources such as conventional typewriters are replaced with nonimpact printers such as laser or ink jet printers, etc.

In the present system, in effect, a softer, cushioned, cam/tray contact is provided, for significantly less audible noise, but without making the actual contacting surfaces softer, which would be undersirable from a wear and product life standpoint. Instead, a controlled or limited partial flexing of cantilevered supporting portions of the operative bin engaging end portions of cam is provided.

A quieter sorter is particularly desirable for sorting the output of electrostatographic reproducing machines in an office environment, such as xerographic office copier or printer output copies. Such a sorter is desirable for job or set collation, or for separation or sorting of plural page job sets as in discrete multibin "mailboxes" at the output of a printer. Moving bin sorters, in which a selected one of plural bins is incrementally moved adjacent a copy output area of a copier or printer, have been found particularly suitable for small compact attached or modular sorter units for copiers or printers. A sorter is particularly desirable for collation and separation of the identical plural multipage copies made on a small copier which does not have a recirculating document handler and thus cannot provide precollated output of plural copy sets made from a plural page document.

If desired, in-bin stapling systems can also be provided with sorters, as in U.S. Pat. Nos. 4,925,171; 3,884,408; 3,944,207; 3,995,748; 4,681,310; 4,687,191; 4,762,312; or 4,801,133. That is an optional feature of sorters not related to this invention.

"C" cam incremental bin drive sorters per se are well known commercially, such as in the Xerox Corporation "5018", "5028", "5034" and "5046" copier sorters. They are also shown, for example, in U.S. Pat. Nos. 4,558,860; 4,589,653; 4,878,660; 4,466,608; 4,391,461; 4,332,377, and/or 4,328,963. Thus their drive systems and function need not be described in detail herein. These "C" cam drives are used to index up and down depending on the cam rotation direction the sorter bins or trays. The terms bins or trays are used interchangeably with regard to sorters. During each bin index, there is a period of time in which the "C" cam is out of contact with a bin or tray. The drive system can then speed up before the cam reengages the next tray, thus increasing the impact. These existing designs typically use a hard plastic molded "C" cam, with operating impact noise from bin incrementing. Such "C" cam incremental bin drives are, however, often cheaper and more compact and/or simpler than other incremental bin drives, such as helical suspensions and drives, such as that shown in U.S. Pat. No. 5,044,625 and art cited therein.

Other art of background interest includes U.S. Pat. No. 4,143,751, which reportedly describes making a sorter quieter through elimination of a drive chain and sorter wheels; and U.S. Pat. No. 4,867,058, which reportedly describes a resilient cam member for a printing apparatus and a movable section having a resilient member such as urethane which absorbs shock.

A version of the disclosed embodiment hereinbelow has been demonstrated to provide a much quieter moving-bin type sorter, with significant operating noise reduction. As shown and described in this embodiment, there is provided a cantilevered flexing of the sorter tray engaging portion of the tray movement cam. Specifically, in this example, the outer, operative end sections of the "C" cam are strong enough to move the bins, yet sufficiently flexible and resilient to absorb the impact noise of the impact of the ends of the "C" as they engage the bin to be moved. I.e., cushioning the shock of the cam impact with the internal tray edge or tray indexing tab, by making the cam, in the areas of impact, compliant. There are disclosed in this embodiment compliant arm sections of the cam on either side of the "C" cam opening, to reduce the shock of the contacting surfaces (the edges of the "C" cam opening, and the tray indexing tabs).

The system herein may be additionally combined with mounting a urethane or the like insert inside the mount of the "C" cam, as an optional additional feature. One embodiment of that, per se, is disclosed in a pending Fuji Xerox Corporation application No. FX-28220, filed in Japan on Feb. 12, 1991 as Japanese Application No. 03-038981. Such a urethane insert inside the "C" cam, as also shown in one example in this embodiment, can minimize recoil of the tray indexing tab resulting from the "C" cam impact with the tray indexing tab, dampening their relative movement, or reducing speed mismatch, to prevent contact chatter or contact/re-contact bounce and consequent noise therefrom.

A specific feature of the specific embodiment(s) disclosed herein is to provide in a moving bins sorter system in which the plural bins of the sorter are sequentially incremented with a rotatable open mouthed "C" cam drive, in which the open ends of said "C" cam on opposite sides of said open mouth provide operative bin engaging cam surfaces for engaging a cam engaging portion of said bins entering said open mouth of said "C" cam, the improvement in said "C" cam for reducing the operating impact noise wherein said "C" cam has cantilevered arms of limited flexibility supporting said bin engaging end portions of said "C" cam to provide limited flexing of at least one of said bin engaging end portions of said "C" cam when at least one of said bin engaging end portions of said "C" cam operatively engages a said cam engaging portion of a said bin, for impact noise reduction.

Further specific features provided by the system disclosed herein, individually or in combination, include those wherein said "C" cam further includes an internal chordal cross brace; and/or wherein said "C" cam further includes undercut or relieved areas to make said cantilevered arms thinner adjacent said bin engaging end portions of said "C" cam; and/or wherein said "C" cam further includes a highly resilient donut shaped member mounted internally of said open mouth of said "C" cam and positioned to partially engage a said cam engaging portion of a said bin entering said open mouth of said "C" cam, for additional impact noise reduction.

In the description herein the term "document" or "sheet" refers to a usually flimsy sheet of paper, plastic, or other such conventional individual image substrate.

All reference cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the example below, as well as the claims. Thus the present invention will be better understood from this description of an embodiment thereof, including the drawing figures (approximately to scale) wherein:

FIG. 1 is a schematic perspective view of one embodiment of the system, in this example, as applied in a Xerox Corporation "5046" copier sorter, like that shown in above-cited U.S. Pat. No. 4,589,653; and FIG. 2 is an enlarged cross-sectional view of the "C" cam per se of the apparatus of FIG. 1.

Describing now in further detail the exemplary embodiment with reference to the Figures, there is shown a sorter 10 with moving bins or trays 12 incrementally driven by a "C" cam 14 rotatably driven by a drive system "M" by way of example of a sorter for sorting or collecting the copy sheets outputted by any reproducing machine. This particular illustrated sorter is basically that of the Xerox Corporation "5046" copier, and the bins 12 here ride up and down on support rods 16, rather than being pivotally mounted, as in some other products and patents, such as the above-cited U.S. Pat. No. 4,558,860 in particular, but the invention is of course not limited thereto.

Figure 2:
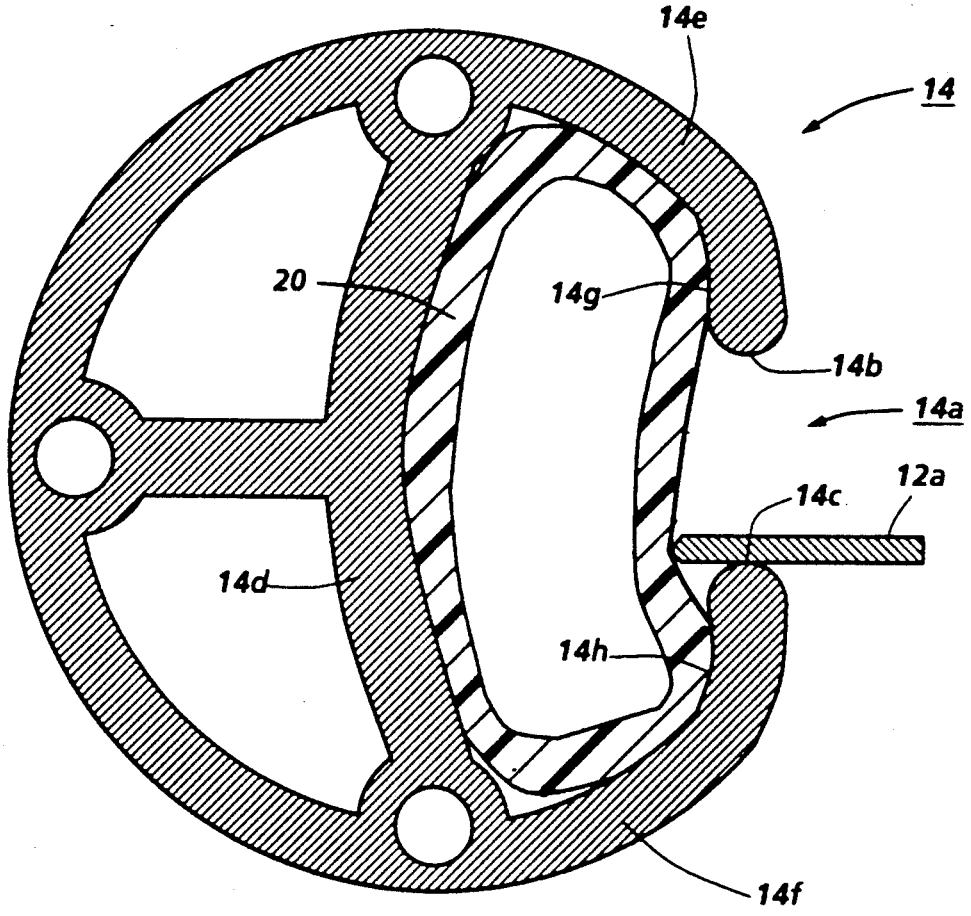

As particularly shown in FIG. 2, the "C" cam 14 here is basically cylindrical except for its opening or open mouth 14*a* into which the ends of each tray indexing tabs 12*a* enter to be engaged one after the other by the edge 14*b* and/or 14*c* of the "C" cam opening 14*a*, (i.e., the ends 14*b* and 14*c* of the "C", which form the actual cam surfaces). The "C" cam 14 here is also basically hollow, except for a basically central chord reinforcing and stiffening cross-linking member 14*d* extending between the two sides of the "C" symmetrically with, and restraining or reinforcing, the opening of the "C" at 14*a*.

However, from the cross-linking member 14*d* out to the ends 14*b*, 14*c*, there are cantilevered (otherwise unsupported) arms 14*e* and 14*f*. These arms 14*e* and 14*f* are stiffly resilient. That is, the arm 14*e* is designed to flex slightly upon forceable impact between its active end 14*b* and a tray indexing tab 12*a*. Likewise, arm 14*f* is designed to flex slightly upon forceable impact between its active end 14*c* and a tray indexing tab 12*a*. There is provided a cantilevered flexing of the tray movement cam 14 engaging portion 12*a* engaging the sorter 10 tray 12. However, it will be appreciated that depending on the particular sorter design and operation, only one of these arms, such as lower arm 14*f*, may actually be operative and need to flex to provide impact absorption and noise reduction. A unitary, single material, one piece, molded cam 14 may be used, with the arms 14*e* and 14*f* being strong enough to move the bins, and with the edges or ends 14*b* and 14*c* of the "C" being hard enough to provide good wear resistance and long life. The desired compliance may be provided by the "C" cam construction, as shown, and by using any suitable plastic material, for example, a known reinforced plastic composite of nylon, or nylon teflon compound. Yet the cam 14 is sufficiently flexible and resilient to absorb the impact noise of the impact of the ends 14*b* or 14*c* of the "C" as they engage the bin 12 to be moved. i.e., cushioning the shock of the cam impact with the tray indexing tab 12*a*. This can be tuned or adjusted by altering material (wall) thicknesses along arms 14*e* and 14*f* and/or adding additional undercuts such as 14*g* and 14*h* to the impacting surfaces 14*b* and 14*c* of the cam 14.

The "C" cam 14 in this example may be mounted to a face plate 18 covering one end outside the tray engagement area (not shown in FIG. 2) which face plate 16 in turn may mount to the drive shaft of the drive system "M" for bidirectional axial rotation of the "C" cam 14. In any case, the "C" cam here may desirably have the same basic dimensions and function as the prior non-flexing "C" cam which it may desirably replace. The above-noted patents on various prior known "C" cam drives are noted for further details and alternatives.

As noted, although not required, an optional additional feature for additional noise reduction comprises gluing in or otherwise mounting a soft rubber or foam rubber insert, such as a urethane "donut" 20 here, inside the mouth of the "C" cam. This is further described in a pending Fuji Xerox Corporation application No. FX-28220, filed in Japan on Feb. 12, 1991 as Japanese Application No. 03-038981, to be published in about 18 months from that date, and also being filed in the United States. Such a urethane insert inside the "C" cam, such as shown in this embodiment, or otherwise, can minimize recoil of the tray indexing tab 12*a* resulting from the "C" cam impact with the tray indexing tab, dampening their relative movement, or reducing speed mismatch, to prevent contact chatter or contact/re-contact bounce and consequent noise therefrom.

For purposes of filing this application in Japanese, the "C" shape of the cam 14 here could also perhaps be described as something like a "new moon" shape.

While the embodiment disclosed herein is preferred, it will be appreciated from this teaching that various alternatives, modifications, variations or improvements therein may be made by those skilled in the art, which are intended to be encompassed by the following claims:

What is claimed is:

1. In a moving bins sorter system in which the plural bins of the sorter are sequentially incremented with a rotatable open mouthed "C" cam drive, in which the open ends of said "C" cam on opposite sides of said open mouth provide operative bin engaging cam surfaces at the outer ends thereof for engaging a surface area of a said bin entering said open mouth of said "C" cam, the improvement in said "C" cam for reducing the operating impact noise with said bin wherein said open ends of said "C" cam comprise cantilevered arms limited in flexibility by an integral chordal cross-connector extending centrally internally across said "C" cam between the inner ends of said cantilevered arms to support said cantilevered arm portions of said "C" cam so as to provide controlled limited flexing of at least one of said bin engaging outer end portions of said "C" cam when said bin engaging end portion of said "C" cam operatively engages a said bin, for impact noise reduction without requiring a softer material for either said "C" cam outer end portion or said engaged bin surface areas.

2. The system of claim 1, wherein said "C" cam further includes undercut or relieved areas to make said cantilevered arms thinner adjacent said bin engaging end portions of said "C" cam.

3. The system of claim 1, wherein said "C" cam further includes a highly resilient donut shaped member mounted internally of said open mouth of said "C" cam and positioned to partially engage a said cam engaging portion of a said bin entering said open mouth of said "C" cam, for additional impact noise reduction.

* * * * *